United States Patent [19]

Hartmann et al.

[11] Patent Number: 5,004,999

[45] Date of Patent: Apr. 2, 1991

[54] EXTENDED RF RANGE ALARM SYSTEM

[75] Inventors: Jon P. Hartmann, Santa Ana; Ted W. Glasener, Orange, both of Calif.

[73] Assignee: Honeywell, Inc., Minneapolis, Minn.

[21] Appl. No.: 454,329

[22] Filed: Dec. 21, 1989

[51] Int. Cl.[5] ..... G08B 1/08

[52] U.S. Cl. ..... 340/539; 340/506; 340/531; 455/67; 455/91; 455/134

[58] Field of Search ..... 340/539, 531, 506; 455/91, 67, 134

[56] References Cited

U.S. PATENT DOCUMENTS

| | | | |
|---|---|---|---|
| 3,848,231 | 11/1974 | Wootton | 340/539 |
| 4,095,211 | 6/1978 | Shaughnessy | 340/539 |
| 4,462,022 | 7/1984 | Stolarczyk | 340/539 |
| 4,523,184 | 6/1985 | Abel | 340/539 |
| 4,603,325 | 7/1986 | Marino et al. | 340/539 |

*Primary Examiner*—Donnie L. Crosland

*Attorney, Agent, or Firm*—Donald J. Lenkszus; Ian D. Mackinnon; Robert B. Leonard

[57] ABSTRACT

A wireless alarm system utilizes pulsed FM transmissions to increase the effective range of the system while meeting FCC requirements for radiated signal strength. The effective range of the system is increased by shortening the duty cycle and increasing the signal strength during the on-time. This results in a low average RF signal strength, however, an increased transmission distance is achieved.

10 Claims, 3 Drawing Sheets

EXTENDED RF RANGE ALARM SYSTEM

BACKGROUND OF THE INVENTION

The invention pertains in general to commercial and residential fire and security alarm systems.

Such alarm systems, and in particular residential alarm systems, may use RF (radio frequency) links between alarm sensors such as magnetic door/window contacts, infrared motion detectors and the like and a main control panel. More specifically multiple RF transmitters are typically used to send messages from the alarm sensor to the main control panel. The RF signals are in accordance with Federal Communications Commission (FCC) rules and regulations transmitted at approximately 315 mHz.

The FCC regulations limit the field strength of 315 MHz alarm devices to a maximum average field strength.

One problem with presently available systems is that installations of such residential alarm systems may experience reception problems due to limitations in the range between the transmitters and receiver due to its low level of permissible field strength of RF transmissions.

In one prior arrangement a pulse width amplitude modulated scheme is used for transmission of data. In that arrangement, bits of data are not sent as contiguous bits. The individual bits are sent as bursts of carrier and for example a "1" might be twice the width of a "0" and there is no carrier between bits.

SUMMARY OF THE INVENTION

In accordance with the principles of the inventor the effective range between a RF transmitter and a RF receiver in an alarm system subject to the FCC mandated regulations is increased by transmitting messages in data bursts or pulses of RF energy which have a field strength higher than the permissible field strength level while maintaining a duty cycle whereby the average field strength is no higher than the FCC mandated level.

BRIEF DESCRIPTION OF THE DRAWINGS

The invention may be better understood from a reading of the following detailed description in conjunction with the drawing figure in which.

DETAILED DESCRIPTION

Figure 1:
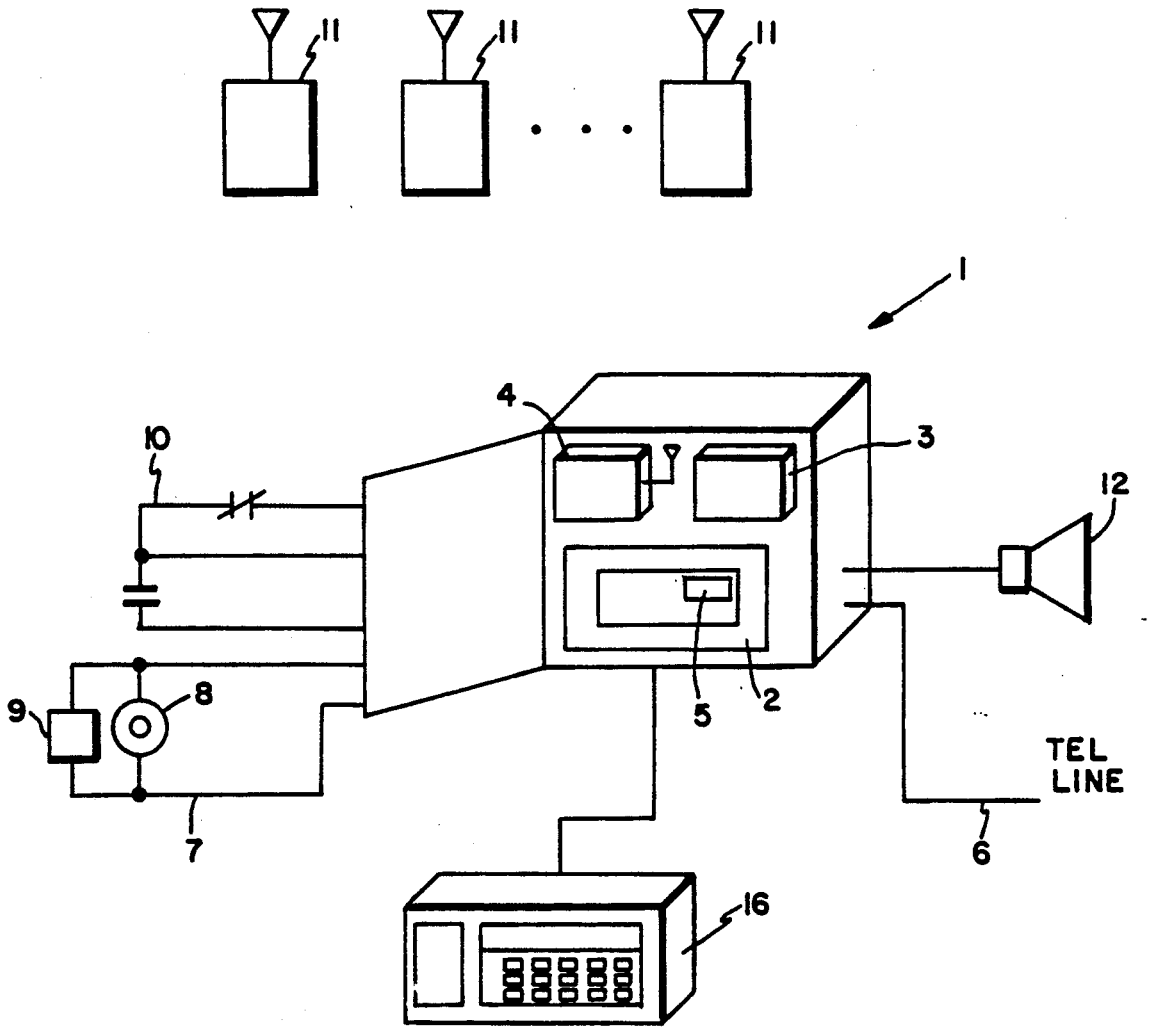
FIG. 1 illustrates an alarm system to which the present invent is advantageously applied.

In the alarm system of FIG. 1, a control panel 1 which may be mounted at a convenient location in a residence includes a control board 2, power supply and battery 3 and an RF receiver 4. A digital dialer 5 is incorporated which can send an account number plus zone number, alarm, trouble and restore messages to a central station receiver via telephone lines 6. The system can accommodate up to seven hardwired loops, including a fire loop 7 which can accommodate a maximum of five smoke detectors 8. The fire loop 7 includes an end of line module 9. Additional hardwire loops 10 may be used for alarm functions and are of the normally open and normally closed types as are typical for such systems. In addition to the hardwired zones, up to 94 RF transmitter point ID numbers can be utilized. Typically each RF transmitter 11 (which may, for example, be a wall mount or hand held transmitter) is assigned its own ID number in the system. Additionally, an audible alarm such as a horn 12 or bell may be connected to the alarm system. A control panel 16 is provided for the system user to activate/deactivate the security and other aspects of the system.

Figure 2:
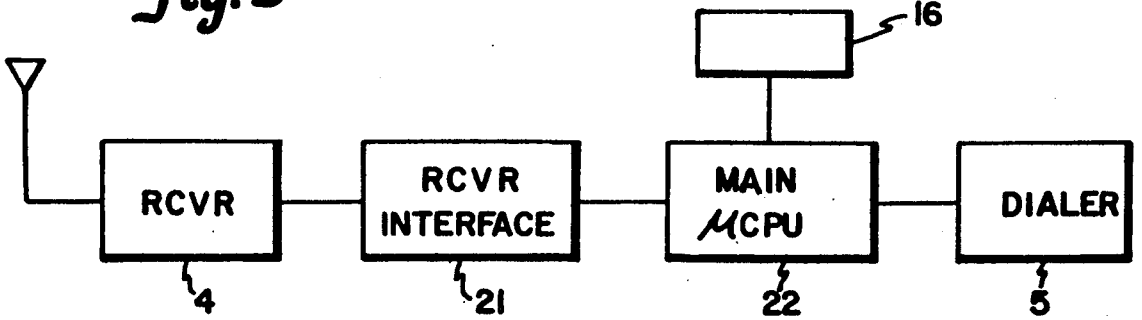
FIG. 2 illustrates a portion of the system of FIG. 1 in block diagram form.

Turning now to FIG. 2, the control board 5 includes a receiver interface 21 having inputs connected to the RF receiver 4. The receiver interface 21 in turn has outputs connected to a main microprocessor unit 22 which in turn controls the operation of dialer 5.

Figure 3:
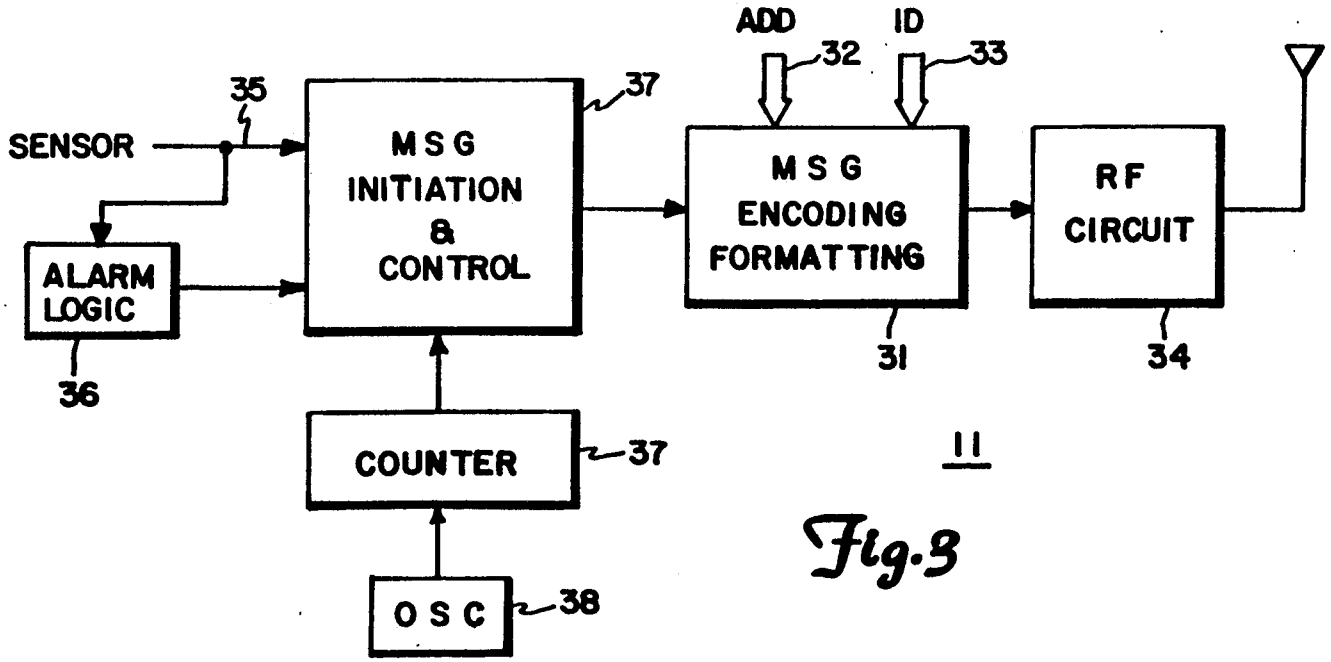
FIG. 3 illustrates the transmitter utilized in the system of FIGS. 1 and 2.

Each transmitter 11 is shown in greater detail in FIG. 3. Each transmitter within the system is assigned an identification address which may typically be set by switches. The receiver to which the messages are to be transmitted is also identified by an address. The address of the receiver is provided to a message encoding and formatting circuit 31 via inputs 32. Likewise, the identification address of the transmitter 11 is provided to circuit 31 via inputs 33. The message encoding and formatting circuit 31 serves to selectively activate RF circuit 34 and to provide message block information to the RF circuit 34 for modulation of the FM signal generated. RF circuit 34 may be of conventional design.

The transmitter 11 has sensor inputs 35 which are coupled directly to alarm logic 36 and a message initiation and control logic block 37. A conventional oscillator 38 serves to drive a counter and timing circuit 39 which provides various time base signals including automated test message timing signals used in the operation of the transmitter.

The message initiation and control logic 37 is used to control the process of message transmission. Message transmission is required under different circumstances depending upon the function of the transmitter, such as, for example, a transition occurrence at sensor input 35 or an automated test message timing signal from counter 39. Message transmission is performed by initiating the message transmission cycle.

When a message transmission cycle is initiated by the message initiator and control logic 37, the message encoding and formatting circuit 31 will generate message blocks.

Figure 4:
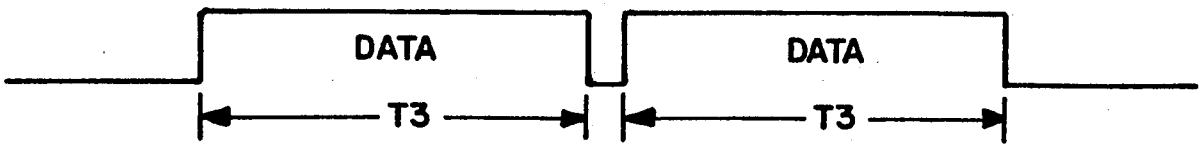
FIG. 4 is a timing diagram of a prior art transmission arrangement.

Turning now to FIG. 4, a timing diagram is shown of a prior art transmission arrangement. Wherein each data transmission is of duration T3. Each data transmission is transmitted over a continuous FM signal and consists of three independent messages transmitted as one data block taking 211 milliseconds with 2 to 3 milliseconds between data blocks. Thus the FM signal is transmitted continuously over the 100 millisecond time period over which the average RF signal output must be measured in compliance with FCC regulations. The data bit rate in this arrangement is 1200 b.p.s.

Figure 5:
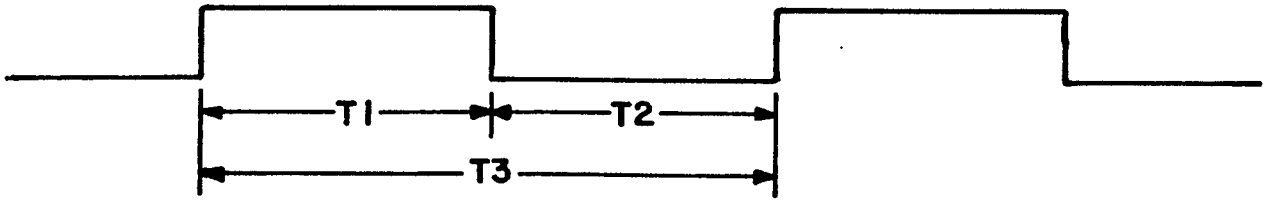
FIG. 5 is a timing diagram in accordance with the present invention.

In accordance with the invention, as shown in FIG. 5 data is transmitted in FM signal pulses wherein T1 is the carrier on time and is 45.65 milliseconds in duration. The off time T2 is minimally 54.35 milliseconds but in accordance with the techniques and arrangement in our copending application entitled Improved Wireless Alarm System, filed on even date herewith and which is incorporated herein by reference, may be greater than that minimal time. With the pulsed transmission arrangement, each data message is transmitted as a separate data block separated by a time interval of at least 54.35 MS. The data bits are contiguous within a data block and are transmitted at the rate of the prior art system, i.e., they are transmitted at 2400 b.p.s.

With this arrangement, averaging the RF signal over the FCC mandated 100 millisecond period results in an average signal level the same as the prior art arrangement and within FCC guidelines. However, the actual signal is transmitted at a higher signal strength resulting in a 6.8 db increase in peak radiated power which effectively increases the range of the transmitter by 1½ to 2 times over that of prior arrangements.

What is claimed is:

1. An alarm system comprising:

a central control including an RF receiver for receiving message information from remote locations;

one or more RF transmitters for generating alarm message information to be transmitted to said receiver, each said transmitter comprising:

an RF energy generator for generating RF signals having an average signal strength which is a predetermined level;

a message source for providing said message information to modulate said RF signals; and means for modulating said RF signals with said message information to produce modulated RF pulses of contiguous data bits, each of said pulses having an instantaneous level of RF field strength substantially greater than said predetermined level and wherein said average signal is calculated over a cycle said cycle comprising the on-time of one of said pulses and the off-time between said pulses.

2. An alarm system in accordance with claim 1 wherein said predetermined time period is 100 milliseconds.

3. An alarm system in accordance with claim 1 wherein said predetermined level is a level mandated by a Federal Commission being the Federal Communications Commission (FCC).

4. An alarm system in accordance with claim 3 wherein said predetermined time period is a period mandated by the FCC.

5. An alarm system in accordance with claim 2 wherein said on-time is 45.65 milliseconds and said off-time is 54.35 milliseconds.

6. An alarm system in accordance with claim 2 wherein said means for modulating said RF signal modulates said RF signal at 2400 b.p.s.

7. A method for transmitting message information with an average RF field strength from a remote location to a central control for an alarm system, the method comprising the steps of:

generating RF signal pulses at a first predetermined pulse rate;

modulating said pulses with said message information to produce modulated RF pulses;

transmitting said modulated RF pulses to a central control, said modulated RF pulses each having an instantaneous RF field strength level and each having an on-time and an off-time such that each of said modulated RF pulses has a substantially high short-term RF field strength level relative to the average RF field strength level of said modulated RF pulses measured over a predetermined time period.

8. The method for transmitting message information of claim 7 wherein said predetermined time period is 100 ms.

9. The method for transmitting message information of claim 8 wherein said on-time is 45.65 ms.

10. The method for transmitting message information in accordance with claim 7 wherein modulating of said pulses is done at 2400 b.p.s.

* * * * *